US007614407B2

(12) United States Patent
Waterman et al.

(10) Patent No.: US 7,614,407 B2
(45) Date of Patent: Nov. 10, 2009

(54) PRIME COAT, INDICIA AND CLEAR COAT REMOVAL PROCESS FOR A GOLF BALL

(75) Inventors: Paul Waterman, Northampton, MA (US); Mario Godbout, Holyoke, MA (US)

(73) Assignee: Callaway Golf Company, Carlsbad, CA (US)

( * ) Notice: Subject to any disclaimer, the term of this patent is extended or adjusted under 35 U.S.C. 154(b) by 352 days.

(21) Appl. No.: 11/835,956

(22) Filed: Aug. 8, 2007

(65) Prior Publication Data

US 2008/0035168 A1 Feb. 14, 2008

Related U.S. Application Data

(60) Provisional application No. 60/821,981, filed on Aug. 10, 2006.

(51) Int. Cl.
*B08B 9/20* (2006.01)

(52) U.S. Cl. ..... 134/25.1; 134/1; 134/25.4; 134/25.5; 134/26; 134/30; 134/32; 134/34; 134/36; 134/38; 134/42; 473/351

(58) Field of Classification Search ..... 134/1, 134/25.1, 25.4, 25.5, 26, 30, 32, 34, 36, 38, 134/42; 473/351
See application file for complete search history.

(56) References Cited

U.S. PATENT DOCUMENTS

| | | | | |
|---|---|---|---|---|
| 3,647,221 | A * | 3/1972 | Holley | 473/376 |
| 5,431,841 | A * | 7/1995 | Lockhart | 510/109 |
| 2005/0132909 | A1 * | 6/2005 | Lutz | 101/41 |
| 2008/0035168 | A1 * | 2/2008 | Waterman et al. | 134/1 |

* cited by examiner

*Primary Examiner*—Sharidan Carrillo
(74) *Attorney, Agent, or Firm*—Michael A. Catania; Elaine H. Lo

(57) ABSTRACT

A process for removing the coating layers from finished golf balls is disclosed herein. The process involves soaking the golf balls in a removal solution and then subjecting the golf balls to ultrasonic treatment in order to remove a coating layer, an indicia and/or a paint layer.

5 Claims, 6 Drawing Sheets

PRIME COAT, INDICIA AND CLEAR COAT REMOVAL PROCESS FOR A GOLF BALL

CROSS REFERENCES TO RELATED APPLICATIONS

The present application claims priority to U.S. Provisional Patent Application No. 60/821,981, filed on Aug. 10, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a coating removal process for a golf ball. More specifically, the present invention relates to a prime coat, indicia and clear coat removal process for a golf ball.

2. Description of the Related Art

Golf balls are typically finished by applying a paint layer, an indicia and a clear coating over various polymer layers. Typically, the cover layer of the golf ball has an aerodynamic pattern such as dimples or a tubular lattice network.

During the finishing process, cosmetic blemishes may appear on the golf balls. If these cosmetic blemishes cannot be removed, the golf ball is scraped or relegated to range ball status. Due to the expense of manufacturing premium golf balls such as the CALLAWAY GOLF® HX® TOUR golf ball, it would be desirable to correct cosmetic blemishes to avoid having to scrape golf balls.

However, any process would have to avoid damaging the aerodynamic pattern while removing the coating layers and indicia (typically a logo).

BRIEF SUMMARY OF THE INVENTION

The present invention provides a solution to recovering cosmetically blemished golf balls without damaging the product properties of the golf ball such as aerodynamics, feel and coefficient of restitution.

The present invention is able to accomplish this by providing a method wherein the finished golf balls are soaked in a solvent then subjected to ultrasonic treatment before being rinsed and subjected to an air knife. In this manner, the recovered ball may be refinished.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 7:
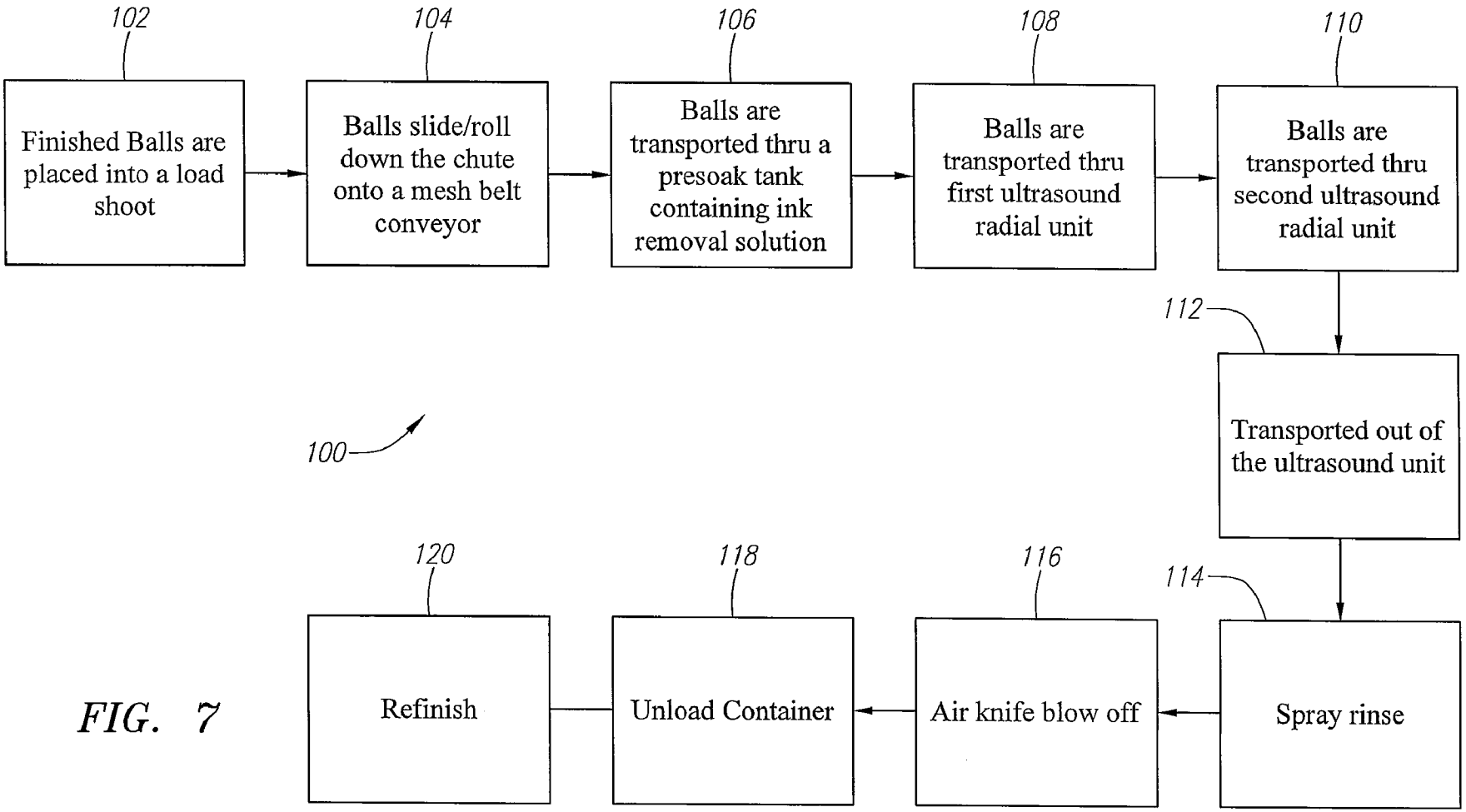
FIG. 7 is a flow chart of a preferred embodiment of the method of the present invention.

The method of the present invention is illustrated in FIG. 7. Typically golf balls have a paint layer, an indicia and a clear coating. Many two-piece golf balls have only an indicia and clear coating since the coloring is integrated into the cover material.

Figure 1:
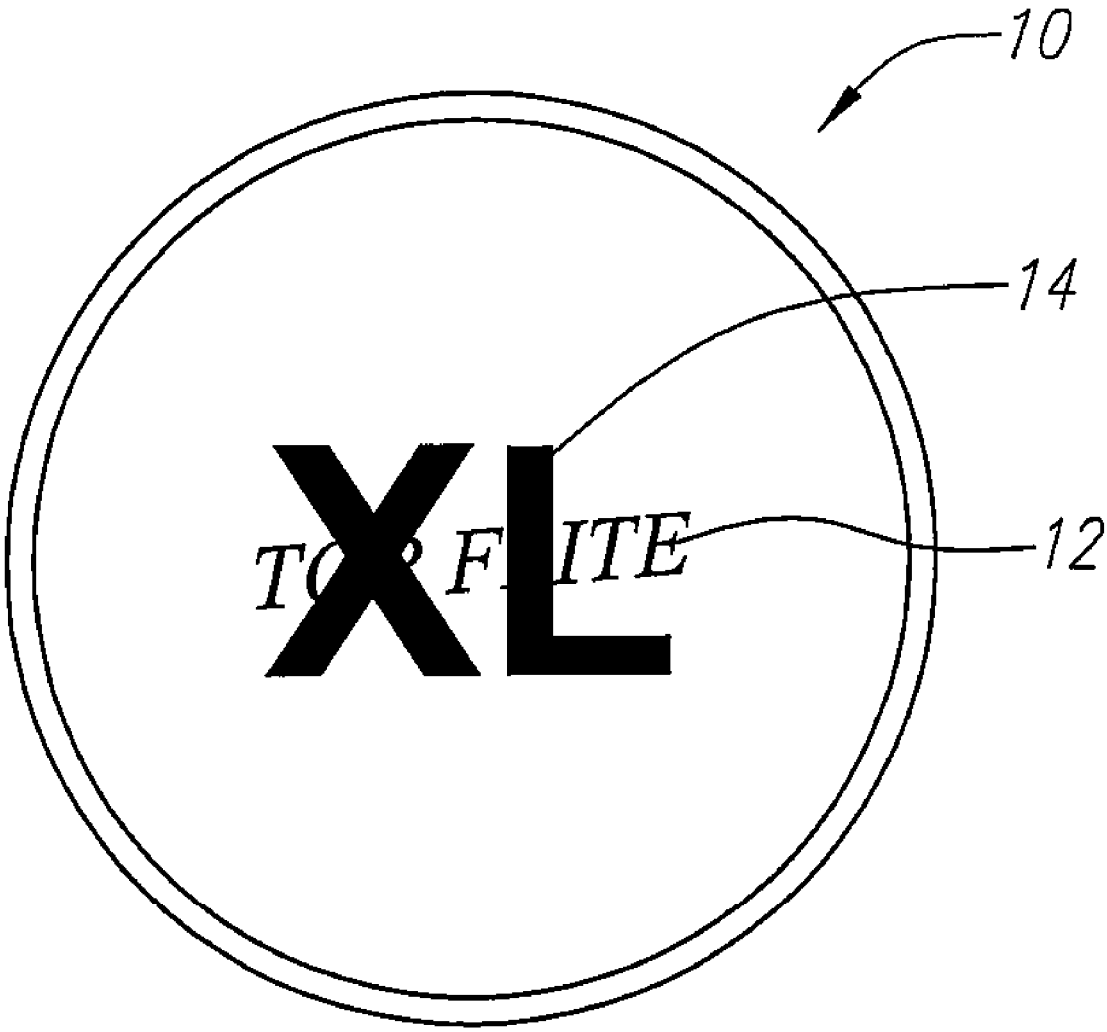
FIG. 1 is a perspective view of a golf ball with indicia thereon.

As shown in FIG. 1, a golf ball is generally designated 10. The golf ball may be a two piece golf ball, three piece golf ball or multiple (greater than three) piece golf ball. The golf ball 10 has a second indicia 12 partially overlapping a first indicia 14.

Figure 2:
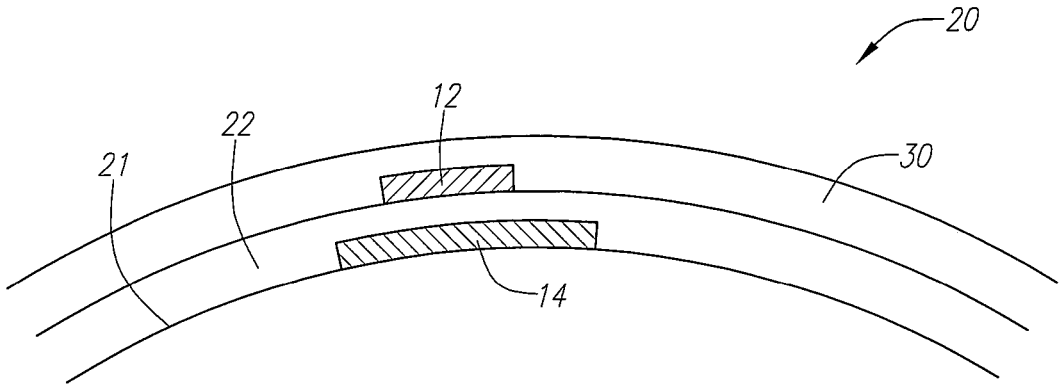
FIG. 2 is an isolated cross-sectional view of a two-piece golf ball with a single coating layer.

As shown in FIG. 2, the golf ball 10 has a core 20 and a cover 22. The core 20 has a surface 21 with the first indicia 14 thereon. The cover 22 is disposed over the core 20 and the first indicia 14. The cover is composed of a transparent material or a semi-translucent material. The second indicia 12 is disposed a surface 23 of the cover 22. The second indicia 12 partially overlaps the first indicia 14. A coating layer 30 is disposed on the cover 22 and the second indicia 12.

Figure 3:
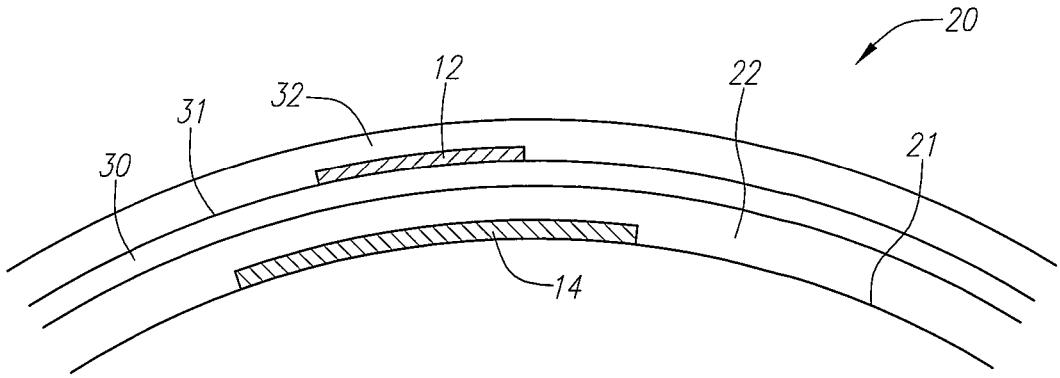
FIG. 3 is an isolated cross-sectional view of a two-piece golf ball with a two coating layers.

As shown in FIG. 3, the golf ball 10 has a core 20 and a cover 22. The core 20 has a surface 21 with the first indicia 14 thereon. The cover 22 is disposed over the core 20 and the first indicia 14. The cover is composed of a transparent material or a semi-translucent material. A first coating layer 30 is disposed over the cover 22. The second indicia 12 is disposed a surface 31 of the first coating layer 30. The second indicia 12 partially overlaps the first indicia 14. A second coating layer 32 is disposed on the first coating layer 30 and the second indicia 12.

Figure 4:
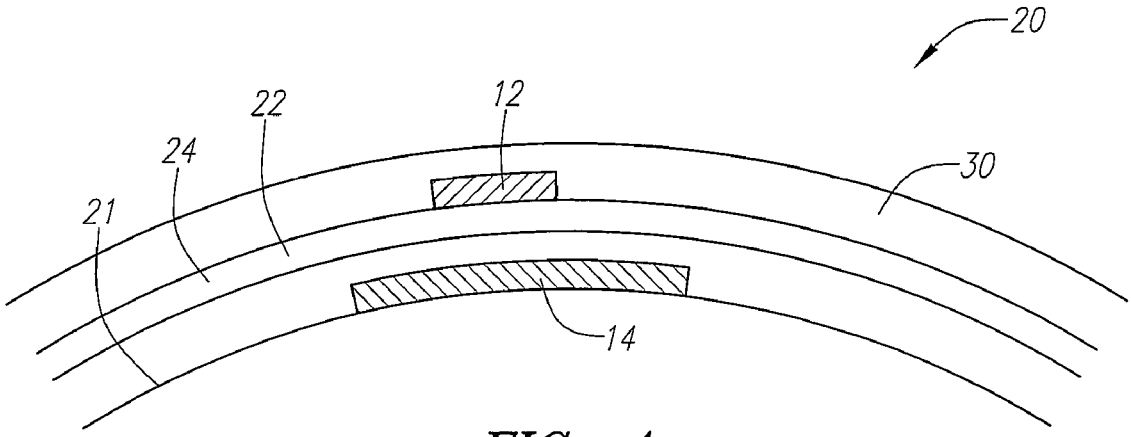
FIG. 4 is an isolated cross-sectional view of a three-piece golf ball with a single coating layer.

As shown in FIG. 4, the golf ball 10 has a core 20, an intermediate layer 24 and a cover 22. The core 20 has a surface 21 with the first indicia 14 thereon. The intermediate layer 24 is disposed over the core and the first indicia 14. The cover 22 is disposed over the intermediate layer 24. The cover 22 and the intermediate layer are each composed of a transparent, semi-translucent or translucent material. The second indicia 12 is disposed a surface 23 of the cover 22. The second indicia 12 partially overlaps the first indicia 14. A coating layer 30 is disposed on the cover 22 and the second indicia 12.

Figure 5:
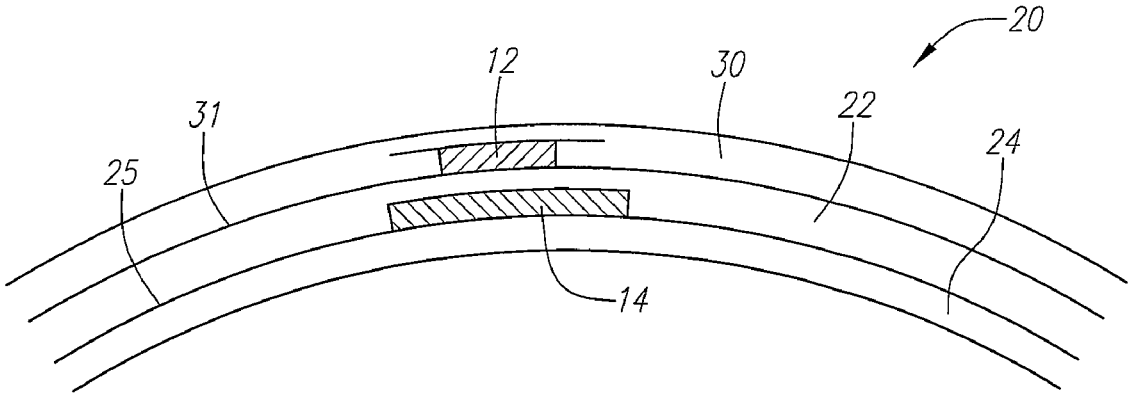
FIG. 5 is an isolated cross-sectional view of a three-piece golf ball with a single coating layer with a first indicia on an intermediate layer and a second indicia on a cover.

As shown in FIG. 5, the golf ball 10 has a core 20, an intermediate layer 24 and a cover 22. The intermediate layer 24 is disposed over the core 20. The intermediate layer 24 has a surface 25 with the first indicia 14 thereon. The cover 22 is disposed over the intermediate layer 24 and the first indicia 14. The cover 22 is composed of a translucent material or a semi-translucent material. A first coating layer 30 is disposed over the cover 22. The second indicia 12 is disposed a surface 31 of the first coating layer 30. The second indicia 12 partially overlaps the first indicia 14.

Figure 6:
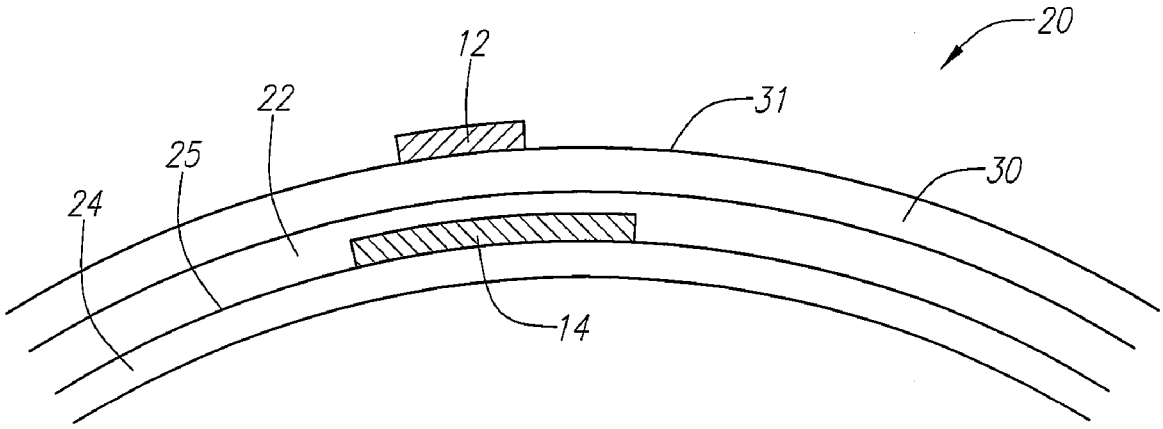
FIG. 6 is an isolated cross-sectional view of a three-piece golf ball with a single coating layer with a first indicia on an intermediate layer and a second indicia on a coating layer.

As shown in FIG. 6, the golf ball 10 has a core 20, an intermediate layer 24 and a cover 22. The intermediate layer 24 is disposed over the core 20. The intermediate layer 24 has a surface 25 with the first indicia 14 thereon. The cover 22 is disposed over the intermediate layer 24 and the first indicia 14. The cover 22 is composed of a transparent material or a semi-translucent material. The second indicia 12 is disposed a surface 23 of the cover 22. The second indicia 12 partially overlaps the first indicia 14. A coating layer 30 is disposed on the cover 22 and the second indicia 12.

Figure 8:
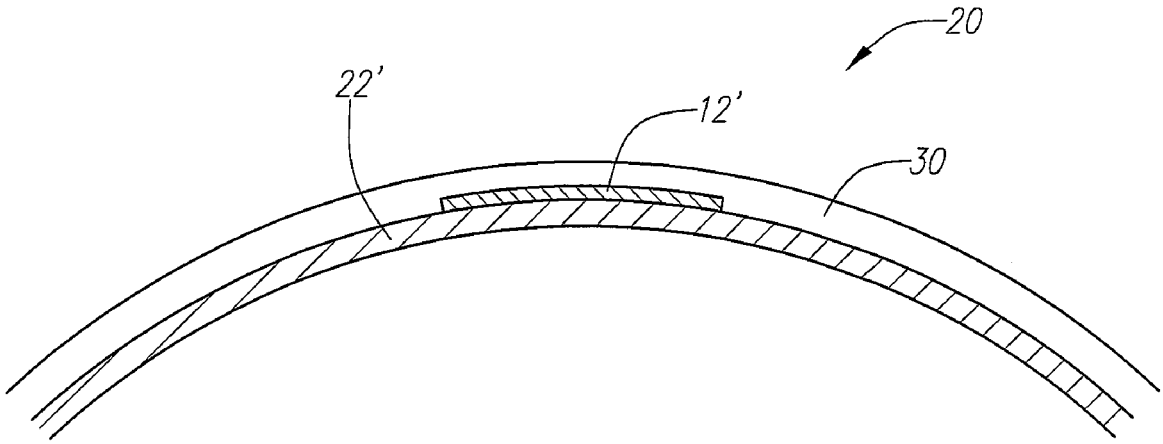
FIG. 8 is an isolated cross-sectional view of a two-piece golf ball with a single coating layer.

As shown in FIG. 8, a clear coating layer 30 covers an indicia 12' which is placed on an ionomer cover 22' disposed on a core 20. Those skilled in the pertinent art will realize that a paint layer could be placed over the cover and the indicia 12' printed on the paint layer with the clear coating 30 coated over both.

U.S. Pat. No. 5,885,173 discloses an indicia for a golf ball and is hereby incorporated by reference in its entirety. U.S. Pat. No. 6,00,1177 discloses painting system for painting a golf ball and is hereby incorporated by reference in its entirety. U.S. Pat. No. 5,300,325 discloses a method for finishing a golf ball and is hereby incorporated by reference in its entirety. U.S. Pat. No. 5,409,233 discloses a coating composition for a golf ball and is hereby incorporated by reference in its entirety. U.S. Pat. No. 5,494,291 discloses a coating composition for a golf ball and is hereby incorporated by reference in its entirety. U.S. Pat. No. 6,146,288 discloses a coating composition for a golf ball and is hereby incorporated by reference in its entirety. U.S. Pat. No. 6,245,386 discloses a method for finishing a golf ball and is hereby incorporated by reference in its entirety.

The core or the dual core of the golf ball precursor product can be formed of a solid, a liquid, or any other substance that will result in an inner ball (core and inner cover layer), having the desired COR, compression and hardness. The multi-layered cover preferably comprises two layers: a first or inner layer or ply and a second or outer layer or ply. The inner layer can be ionomer, ionomer blends, non-ionomer, non-ionomer blends, or blends of ionomer and non-ionomer. The outer layer is may besofter than the inner layer and can be thermoplastic polyurethane, polyurea, polyurethane/polyurea blends, or a blend of a polyurethane/polyurea and ionomer or non-ionomer.

The inner layer is comprised of a hard, high acid (i.e. greater than 16 weight percent acid) ionomer resin or high acid ionomer blend. The inner layer is comprised of a blend of two or more high acid (i.e. at least 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball. In an additional embodiment, the inner layer is comprised of a hard, low acid (i.e. 16 weight percent acid or less) ionomer blend. Preferably, the inner layer is comprised of a blend of two or more low acid (i.e. 16 weight percent acid or less) ionomer resins neutralized to various extents by different metal cations. The inner cover layer may or may not include a metal stearate (e.g., zinc stearate) or other metal fatty acid salt.

It has been found that a hard inner layer provides for a substantial increase in resilience (i.e., enhanced distance) over known multi-layer covered balls. The softer outer layer provides for desirable "feel" and high spin rate while maintaining respectable resiliency. The soft outer layer allows the cover to deform more during impact and increases the area of contact between the clubface and the cover, thereby imparting more spin on the ball. As a result, the soft cover provides the ball with a balata-like feel and playability characteristics with improved distance and durability. Consequently, the overall combination of the inner and outer cover layers results in a golf ball having enhanced resilience (improved travel distance) and durability (i.e. cut resistance, etc.) characteristics while maintaining and in many instances, improving, the playability properties of the ball.

The combination of a hard inner cover layer or layers with a soft, relatively low modulus thermoplastic polyurethane, polyurea or polyurethane/polyurea outer cover layer provides for excellent overall coefficient of restitution (for example, excellent resilience) because of the improved resiliency produced by the inner cover layer. While some improvement in resiliency is also produced by the outer cover layer, the outer cover layer generally provides for a more desirable feel and high spin, particularly at lower swing speeds with highly lofted clubs such as half wedge shots.

Preferably, the inner cover layer is harder than the outer cover layer and generally has a thickness in the range of 0.010 to 0.150 inches, preferably 0.010 to 0.100 inches, more preferably 0.020 to 0.060 inches for a 1.68 inch ball and 0.030 to 0.100 inches for a 1.72 inch (or more) ball. The core and inner cover layer together form an inner ball having a coefficient of restitution of 0.750 or more and more preferably 0.790 or more, and a diameter in the range of 1.48 to 1.67 inches for a 1.68 inch ball and 1.50 to 1.71 inches for a 1.72 inch (or more) ball. The inner cover layer has a Shore D hardness of 60 or more (or at least about 80 Shore C). It is particularly advantageous if the golf balls of the invention have an inner layer with a Shore D hardness of 65 or more (or at least about 94 Shore C). If the inner layer is too thin, it is very difficult to accurately measure the Shore D, and sometimes the Shore C, of the inner layer as the layer may puncture. Additionally, if the core is harder, this will sometimes influence the reading. If the Shore C or Shore D is measured on a plaque of material, different values will result. The above-described characteristics of the inner cover layer provide an inner ball having a PGA compression of 100 or less. It is found that when the inner ball has a PGA compression of 90 or less, excellent playability results.

The inner layer compositions of the embodiments described herein may include the high acid ionomers such as those developed by E.I. DuPont de Nemours & Company under the trademark Surlyn® and by Exxon Corporation under the trademarks Escor® or Iotek®, or blends thereof.

The high acid ionomers which may be suitable for use in formulating the inner layer compositions of various embodiments of the invention are ionic copolymers which are the metal, (such as sodium, zinc, magnesium, etc.), salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10-100%, preferably 30-70%) by the metal ions. Each of the high acid ionomer resins which may be included in the inner layer cover compositions of the invention contains greater than about 16% by weight of a carboxylic acid, preferably from about 17% to about 25% by weight of a carboxylic acid, more preferably from about 18.5% to about 21.5% by weight of a carboxylic acid.

The high acid ionomeric resins available from Exxon under the designation Escor® or Iotek®, are somewhat similar to the high acid ionomeric resins available under the Surlyn® trademark. However, since the Escor®/Iotek® ionomeric resins are sodium or zinc salts of poly(ethylene-acrylic acid) and the Surlyn® resins are zinc, sodium, magnesium, etc. salts of poly(ethylene-methacrylic acid), distinct differences in properties exist.

Examples of the high acid methacrylic acid based ionomers found suitable for use in accordance with this invention include Surlyn® 8220 and 8240 (both formerly known as forms of Surlyn® AD-8422), Surlyn®9220 (zinc cation), Surlyn® SEP-503-1 (zinc cation), and Surlyn® SEP-503-2 (magnesium cation). According to DuPont, all of these ionomers contain from about 18.5 to about 21.5% by weight methacrylic acid.

Examples of the high acid acrylic acid based ionomers suitable for use in the present invention also include the Escor® or Iotek® high acid ethylene acrylic acid ionomers produced by Exxon such as Ex 1001, 1002, 959, 960, 989, 990, 1003, 1004, 993, 994. In this regard, Escor® or Iotek® 959 is a sodium ion neutralized ethylene-acrylic neutralized ethylene-acrylic acid copolymer. According to Exxon, Ioteks® 959 and 960 contain from about 19.0 to about 21.0% by weight acrylic acid with approximately 30 to about 70 percent of the acid groups neutralized with sodium and zinc ions, respectively.

Furthermore, as a result of the development by the assignee of this application of a number of high acid ionomers neutralized to various extents by several different types of metal cations, such as by manganese, lithium, potassium, calcium and nickel cations, several high acid ionomers and/or high acid ionomer blends besides sodium, zinc and magnesium high acid ionomers or ionomer blends are now available for golf ball cover production. It has been found that these additional cation neutralized high acid ionomer blends produce inner cover layer compositions exhibiting enhanced hardness and resilience due to synergies that occur during processing. Consequently, the metal cation neutralized high acid ionomer resins recently produced can be blended to produce substantially higher C.O.R.'s than those produced by the low acid ionomer inner cover compositions presently commercially available.

More particularly, several metal cation neutralized high acid ionomer resins have been produced by the assignee of this invention by neutralizing, to various extents, high acid copolymers of an alpha-olefin and an alpha, beta-unsaturated carboxylic acid with a wide variety of different metal cation salts. This discovery is the subject matter of U.S. Pat. No. 5,688,869, incorporated herein by reference. It has been found that numerous metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (for example, from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred.

The softening comonomer that can be optionally included in the inner cover layer for the golf ball of the invention may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 39 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

Along these lines, examples of the preferred high acid base copolymers which fulfill the criteria set forth above, are a series of ethylene-acrylic copolymers which are commercially available from The Dow Chemical Company, Midland, Mich., under the Primacor® designation.

The metal cation salts utilized in the invention are those salts that provide the metal cations capable of neutralizing, to various extents, the carboxylic acid groups of the high acid copolymer. These include acetate, oxide or hydroxide salts of lithium, calcium, zinc, sodium, potassium, nickel, magnesium, and manganese.

Examples of such lithium ion sources are lithium hydroxide monohydrate, lithium hydroxide, lithium oxide and lithium acetate. Sources for the calcium ion include calcium hydroxide, calcium acetate and calcium oxide. Suitable zinc ion sources are zinc acetate dihydrate and zinc acetate, a blend of zinc oxide and acetic acid. Examples of sodium ion sources are sodium hydroxide and sodium acetate. Sources for the potassium ion include potassium hydroxide and potassium acetate. Suitable nickel ion sources are nickel acetate, nickel oxide and nickel hydroxide. Sources of magnesium include magnesium oxide, magnesium hydroxide, and magnesium acetate. Sources of manganese include manganese acetate and manganese oxide.

The metal cation neutralized high acid ionomer resins are produced by reacting the high acid base copolymer with various amounts of the metal cation salts above the crystalline melting point of the copolymer, such as at a temperature from about 200° F. to about 500° F., preferably from about 250° F. to about 350° F. under high shear conditions at a pressure of from about 10 psi to 10,000 psi. Other well known blending techniques may also be used. The amount of metal cation salt utilized to produce the new metal cation neutralized high acid based ionomer resins is the quantity which provides a sufficient amount of the metal cations to neutralize the desired percentage of the carboxylic acid groups in the high acid copolymer. The extent of neutralization is generally from about 10% to about 90%.

A number of different types of metal cation neutralized high acid ionomers can be obtained from the above-indicated process. These include high acid ionomer resins neutralized to various extents with manganese, lithium, potassium, calcium and nickel cations. In addition, when a high acid ethylene/acrylic acid copolymer is utilized as the base copolymer component of the invention and this component is subsequently neutralized to various extents with the metal cation salts producing acrylic acid based high acid ionomer resins neutralized with cations such as sodium, potassium, lithium, zinc, magnesium, manganese, calcium and nickel, several cation neutralized acrylic acid based high acid ionomer resins are produced.

When compared to low acid versions of similar cation neutralized ionomer resins, the new metal cation neutralized high acid ionomer resins exhibit enhanced hardness, modulus and resilience characteristics. These are properties that are particularly desirable in a number of thermoplastic fields, including the field of golf ball manufacturing.

When utilized in the construction of the inner layer of a multi-layered golf ball, it has been found that the acrylic acid based high acid ionomers extend the range of hardness beyond that previously obtainable while maintaining the beneficial properties (i.e. durability, click, feel, etc.) of the softer low acid ionomer covered balls, such as balls produced utilizing the low acid ionomers disclosed in U.S. Pat. Nos. 4,884,814 and 4,911,451. By using these high acid ionomer resins, harder, stiffer inner cover layers having higher C.O.R.s, and thus longer distance, can be obtained.

More preferably, it has been found that when two or more of the above-indicated high acid ionomers, particularly blends of sodium and zinc high acid ionomers, are processed to produce the covers of multi-layered golf balls, (for example, the inner cover layer or layers herein) the resulting golf balls will travel further than previously known multi-layered golf balls produced with low acid ionomer resin covers due to the balls' enhanced coefficient of restitution values.

Alternatively, if the inner cover layer comprises a low acid, the low acid ionomers which may be suitable for use in formulating the inner layer compositions of the subject invention are ionic copolymers which are the metal, (sodium, zinc, magnesium, etc.), salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10 to 100%, preferably 30 to 70%) by the metal ions. Each of the low acid ionomer resins which may be included in the inner layer cover compositions of the invention contains 16% by weight or less of a carboxylic acid.

The inner layer compositions include the low acid ionomers such as those developed and sold by E.I. DuPont de Nemours & Company under the trademark Surlyn® and by Exxon Corporation under the trademarks Escor® or Iotek®, or blends thereof.

The low acid ionomer resins available from Exxon under the designation Escor® and/or Iotek®, are somewhat similar to the low acid ionomeric resins available under the Surlyn® trademark. However, since the Escor®/Iotek® ionomeric resins are sodium or zinc salts of poly(ethylene-acrylic acid) and the Surlyn® resins are zinc, sodium, magnesium, etc. salts of poly(ethylene-methacrylic acid), distinct differences in properties exist.

When utilized in the construction of the inner layer of a multi-layered golf ball, it has been found that the low acid ionomer blends extend the range of compression and spin rates beyond that previously obtainable. More preferably, it has been found that when two or more low acid ionomers, particularly blends of sodium and zinc ionomers, are processed to produce the covers of multi-layered golf balls, (for example, the inner cover layer herein) the resulting golf balls will travel further and at an enhanced spin rate than previously known multi-layered golf balls. Such an improvement is particularly noticeable in enlarged or oversized golf balls.

Suitable non-ionomeric materials include metallocene catalyzed polyolefins or polyamides, polyamide/ionomer blends, polyphenylene ether/ionomer blends, etc., which have a Shore D hardness of at least 60 (or at least about 80 Shore C) and a flex modulus of greater than about 15,000, more preferably about 30,000 psi, or other hardness and flex modulus values which are comparable to the properties of the ionomers described above. Other suitable materials include but are not limited to thermoplastic or thermosetting polyurethanes, thermoplastic block polyesters, for example, a polyester elastomer such as that marketed by DuPont under the trademark Hytrel®, or thermoplastic block polyamides, for example, a polyether amide such as that marketed by Elf Atochem S. A. under the trademark Pebax®, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

While the core with the hard inner cover layer formed thereon provides the multi-layer golf ball with power and distance, the outer cover layer is preferably comparatively softer than the inner cover layer. The softness provides for the feel and playability characteristics typically associated with balata or balata-blend balls. The outer cover layer or ply is comprised of a relatively soft, low modulus (about 1,000 psi to about 100,000 psi, preferably about 5,000 psi to about 70,000) thermoplastic polyurethane, polyurea or polyurethane/polyurea, or a blend of two or more polyurethanes, or a blend of one or more ionomers or one or more non-ionomeric thermoplastic materials with a thermoplastic polyurethane. The outer layer is 0.005 to about 0.150 inch in thickness, preferably 0.010 to 0.075 inch in thickness, more desirably 0.015 to 0.040 inch in thickness, but thick enough to achieve desired playability characteristics while minimizing expense. Thickness is defined as the average thickness of the non-dimpled areas of the outer cover layer. The outer cover layer preferably has a Shore C hardness of less than 98, preferably 95 or less, and more preferably 90 or less, as measured on the surface of the golf ball. If the inner layer and/or core are harder than the outer layer, this will sometimes influence the reading. If the Shore C is measured on a plaque of material, different values may result.

The outer cover layer is formed over a core to result in a golf ball having a coefficient of restitution of at least 0.750, more preferably at least 0.780, and most preferably at least 0.790. The coefficient of restitution of the ball will depend upon the properties of both the core and the cover. The PGA compression of the golf ball is 100 or less, and preferably is 90 or less.

In polyurethanes, cross-linking occurs between the isocyanate groups (—NCO) and the polyol's hydroxyl end-groups (—OH), and/or with already formed urethane groups. Additionally, the end-use characteristics of polyurethanes can also be controlled by different types of reactive chemicals and processing parameters. For example, catalysts are utilized to control polymerization rates.

Generally, thermoplastic polyurethanes have some cross-linking, but primarily by physical means. The cross-link bonds can be reversibly broken by increasing temperature, as occurs during molding or extrusion. In this regard, thermoplastic polyurethanes can be injection molded, and extruded as sheet and blow film. They can be used up to about 350° F. to 450° F. and are available in a wide range of hardnesses.

The thermoplastic polyurethane, polyurea or polyurethane/polyurea which is selected for use as a golf ball cover preferably has a Shore C hardness of from about 98 or less, more preferably about 95 or less, and most preferably about 90 or less when measured on the surface of the golf ball. The thermoplastic polyurethane, polyurea or polyurethane/polyurea which is to be used for a cover layer preferably has a flex modulus from about 1 to about 310 Kpsi, more preferably from about 5 to about 100 Kpsi, and most preferably from about 5 to about 70 Kpsi. Accordingly, covers comprising these materials exhibit similar properties.

Moreover, in alternative embodiments, either the inner and/or the outer cover layer may also additionally comprise up to 100 wt % of a soft, low modulus, non-ionomeric thermoplastic or thermoset material. Non-ionomeric materials are suitable so long as they produce the playability and durability characteristics desired without adversely affecting the enhanced travel distance characteristic produced by the high acid ionomer resin composition. These include but are not limited to styrene-butadiene-styrene block copolymers, including functionalized styrene-butadiene-styrene block copolymers, styrene-ethylene-butadiene-styrene (SEBS) block copolymers such as Kraton® materials from Shell Chem. Co., and functionalized SEBS block copolymers; metallocene catalyzed polyolefins; ionomer/rubber blends such as those in Spalding U.S. Pat. Nos. 4,986,545; 5,098,105 and 5,187,013; silicones; and Hytrel® polyester elastomers from DuPont and Pebax® polyetheramides from Elf Atochem S. A. A preferred non-ionomeric material suitable for the inner and/or outer cover layer includes polyurethane.

Additional materials may also be added to the inner and outer cover layer as long as they do not substantially reduce the playability properties of the ball. Such materials include dyes (for example, Ultramarine Blue™ sold by Whittaker, Clark, and Daniels of South Plainsfield, N.J.) (see U.S. Pat. No. 4,679,795); pigments such as titanium dioxide, zinc oxide, barium sulfate and zinc sulfate; UV absorbers; antioxidants; antistatic agents; and stabilizers. Moreover, the cover compositions of the present invention may also contain softening agents such as those disclosed in U.S. Pat. Nos. 5,312,857 and 5,306,760, including plasticizers, metal stearates and other type of metallic fatty acids, processing acids, etc., and reinforcing materials such as glass fibers and inorganic fillers, as long as the desired properties produced by the golf ball covers of the invention are not impaired.

A general method of the invention is shown in FIG. 7 and generally designated 100. At block 102 the finished golf balls with blemishes are placed in a load shoot. At block 104 the golf balls are slid down a chute onto a mesh conveyor belt or similar apparatus. At block 106 the golf ball s are transported to a presoak tank which is filled with a removal solution. The removal solution is preferably a blend of organic and non-organic components. More preferably the solution is a blend of benzyl alcohol, alkyl methyl ester, cyclic amide and N-methyl-2pyrrolidone. The golf balls are preferably left in the solution for approximately five minutes at a temperature of 144° F. Other times and temperatures are possible.

Next, the soaked golf balls are subjected to ultrasound treatment. At block 108 the soaked golf balls are transported to a first ultrasound radial unit. At this station, each of the soaked golf balls is subjected to 1000 watt radial type transducer for a time period ranging from 5 seconds to 20 seconds. At block 110, the initially ultrasound treated golf balls are transported to a second ultrasound radial unit. At this station, each of the initially ultrasound treated golf balls is subjected to 1000 watt radial type transducer for a time period ranging from 5 seconds to 20 seconds. At block 112, the fully ultrasound treated golf balls transported out of the ultrasound stations.

Next, the fully ultrasound treated golf balls are rinsed. At block 114, the fully ultrasound treated golf balls are rinsed with water to remove any remaining solution and to assist in the removal of the coating layers. At block 116, the rinsed golf balls are subjected to an air knife to further remove coating layers and any solution. At block 118, the recovered golf balls are unloaded to a container. At block 120, the recovered golf balls are refinished.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for removing coating layers and indicia from a plurality of golf balls, the method comprising the sequential steps of:

placing a plurality of finished golf balls in a load shoot;

delivering the plurality of finished golf balls from the load shoot to a mesh belt conveyor;

transporting the plurality of finished golf balls on the mesh belt conveyor through a pre-soak tank containing a removal solution, wherein the removal solution comprises benzyl alcohol, alkyl methyl ester, cyclic amide and N-methyl-2-pyrrolidone;

transporting the plurality of finished golf balls through a first ultrasound radial unit to subject each of the plurality of finished golf balls to a first ultrasound treatment;

transporting the plurality of finished golf balls through a second ultrasound radial unit to subject each of the plurality of finished golf balls to a second ultrasound treatment to create a plurality of treated golf balls;

transporting the plurality of treated golf balls to a spray rinse station and spray rinsing each of the plurality of treated golf balls to create a plurality of rinsed golf balls; and transporting the plurality of rinsed golf balls to an air knife blowing station and air-knife blowing each of the plurality of rinsed golf balls, wherein said coating layers and indicia are removed from each of the plurality of golf balls.

2. The method according to claim 1 wherein the first ultrasound radial unit comprises a 1000 watt radial type transducer and the treatment time ranges from 5 second to 20 seconds.

3. The method according to claim 1 wherein the second ultrasound radial unit comprises a 1000 watt radial type transducer and the treatment time ranges from 5 second to 20 seconds.

4. The method according to claim 1 wherein each of the plurality of finished golf balls is subjected to the removal solution for a time period ranging from 1 minute to 10 minutes and a temperature ranging from 100° F. to 200° F.

5. A method for removing coating layers and indicia from a plurality of golf balls, the method comprising:

soaking a plurality of finished golf balls in a removal solution to create a plurality of soaked golf balls, the removal solution comprising benzyl alcohol, alkyl methyl ester, cyclic amide and N-methyl-2-pyrrolidone;

subjecting the plurality of soaked golf balls to an ultrasonic treatment for a period ranging from 1 second to 20 seconds at a power level ranging from 500 watts to 5000 watts to created a plurality of treated golf balls;

rinsing the plurality of treated golf balls with water to create a plurality of rinsed golf balls; and subjecting the plurality of rinsed golf balls to an air knife, wherein said coating layers and indicia are removed from each of the plurality of golf balls.

* * * * *